US007926138B2

(12) United States Patent
Lee

(10) Patent No.: US 7,926,138 B2
(45) Date of Patent: Apr. 19, 2011

(54) LAUNDRY TREATMENT APPARATUS AND LEAKAGE CONTROLLING METHOD THEREOF

(75) Inventor: Young Wook Lee, Chanwon-si (KR)

(73) Assignee: LG Electronics Inc., Seoul (KR)

( * ) Notice: Subject to any disclaimer, the term of this patent is extended or adjusted under 35 U.S.C. 154(b) by 702 days.

(21) Appl. No.: 11/590,918

(22) Filed: Nov. 1, 2006

(65) Prior Publication Data

US 2007/0101512 A1 May 10, 2007

(30) Foreign Application Priority Data

Nov. 2, 2005 (KR) ..... 10-2005-0104419

(51) Int. Cl.
*D06F 37/42* (2006.01)

(52) U.S. Cl. ..... 8/158

(58) Field of Classification Search ..... 8/158, 159; 68/12.01, 12.27, 208
See application file for complete search history.

(56) References Cited

U.S. PATENT DOCUMENTS

| | | | | |
|---|---|---|---|---|
| 3,874,403 | A * | 4/1975 | Fischer | 137/386 |
| 5,424,940 | A * | 6/1995 | Ousborne | 700/1 |
| 6,147,613 | A * | 11/2000 | Doumit | 340/605 |
| 6,526,807 | B1 * | 3/2003 | Doumit et al. | 73/40.5 R |
| 2004/0163185 | A1 * | 8/2004 | Kim et al. | 8/158 |
| 2004/0226320 | A1 * | 11/2004 | Bongini | 68/3 R |
| 2006/0081014 | A1 * | 4/2006 | Choi et al. | 68/3 R |
| 2006/0191323 | A1 * | 8/2006 | Garabedian et al. | 73/40 |

* cited by examiner

*Primary Examiner* — Joseph L Perrin
(74) *Attorney, Agent, or Firm* — KED & Associates, LLP

(57) ABSTRACT

A laundry treatment apparatus and a controlling method thereof are disclosed. The laundry treatment apparatus includes a leakage detecting device detecting washing water leaking to the lower side of a casing, an auxiliary power supply recharged when a main electric power is supplied, and a controller controlling the auxiliary electric power supply according to the detection by the leakage detecting device. According to the leakage controlling method, since the external electric power inputted to the laundry treatment apparatus is interrupted and the auxiliary power supply is recharged during the supplying of the main electric power to the laundry treatment apparatus when the leakage is detected, an electric leakage and other accidents can be prevented, and an informing device is controlled by the auxiliary power supply so that the leakage can be measured.

8 Claims, 5 Drawing Sheets

LAUNDRY TREATMENT APPARATUS AND LEAKAGE CONTROLLING METHOD THEREOF

This Nonprovisional application claims priority under 35 U.S.C. §119(a) on Patent Application No. 10-2005-0104419 filed in Korea on Nov. 2, 2005, the entire contents of which are hereby incorporated by reference.

BACKGROUND

1. Field of the Invention

The present invention relates to a laundry treatment apparatus and a leakage controlling method thereof, and more particularly, to a laundry treatment apparatus and a leakage controlling method thereof, which detects and determines whether a washing water collected in the base of the laundry treatment apparatus due to the leakage from a water supply valve or a tub, and controls the operating state of the laundry treatment apparatus to prevent the leakage and informs a user that the water leaks.

2. Discussion of Related Art

In general, a laundry treatment apparatus is an apparatus washing the laundry by the action of a detergent and water in the state that the laundry is accommodated in a drum, and may be classified into a clothes washing machine for only washing clothes and a clothes washing machine for washing and drying clothes.

The laundry treatment apparatus includes a tub for containing washing water mixed with a detergent at a washing mode and a fresh water at a rinsing mode, a water supply device for supplying the washing water mixed with a detergent or a fresh water (hereinafter, referred to as a 'washing water') to the tub, and a drainage device for exhausting the washing water in the tub out of the laundry treatment apparatus.

The supply device and the drainage device are installed such that the passages of washing water are closed with the tub.

In a conventional laundry treatment apparatus, when the tub, the water supply device, the drainage device, or components of them are assembled erroneously, the crack of the components or the crack of coupling regions between the components, or the like occur, the washing water may be leaked, thereby reducing washing efficiency and causing waste of water.

Further, if the leakage of the washing water is not repaired, electric component are shorted due the leaked washing water so that the laundry treatment apparatus may be out of order or components of the laundry treatment apparatus are damaged.

SUMMARY OF THE INVENTION

The present invention has been developed to solve the problems in the prior art. It is an object of the present invention to provide a laundry treatment apparatus for preventing an accident from being generated due to a leakage by detecting a leakage of washing water and taking appropriate measures, and a controlling method thereof.

It is other object of the present invention to provide a laundry treatment apparatus for informing a user whether washing water leaks, even in the state that an external power to the laundry treatment apparatus is interrupted, and a controlling method thereof.

It is another object of the present invention to provide a laundry treatment apparatus for determining whether washing water is leaked temporarily or continuously to determine whether the leakage may damage the laundry treatment apparatus, and a controlling method thereof.

In order to accomplish the above aspects, there is provided a laundry treatment apparatus according to the present invention, including a casing; a tub installed in the casing; a drum disposed in the tub to rotate; a driving device to rotate the drum; a water supply device to supply washing water to the tub; a drainage device to drain the wash water from the tub; a leakage detecting device to detect the washing water leaked to a lower side of the casing; an auxiliary power supply recharged while a main electric power is supplied; and a controller to control the auxiliary power supply according to the detection by the leakage detecting device.

The laundry treatment apparatus according to the present invention further includes an informing device controlled by the controller to inform the exterior the leakage detected by the leakage detecting device.

The auxiliary power supply is connected to supply a recharged auxiliary electric power to the informing device.

The informing device includes at least one of a control panel installed to display operating information of the laundry treatment apparatus and a sound device to display operating information of the laundry treatment apparatus in sound.

The leakage detecting device is provided in a base of the casing.

The base of the casing includes a water reservoir in which the washing water is contained and the leakage detecting device is installed.

There is provided a leakage controlling method of a laundry treatment apparatus according to the present invention comprising: detecting a leakage in a casing with a leakage detecting device; interrupting an external electric power supplied to the laundry treatment apparatus when the leakage is detected in the detecting; and supplying an auxiliary power recharged while a main electric power is supplied.

The leakage controlling method of the laundry treatment apparatus further includes stopping the supply of the washing water when the leakage is detected in the detecting and the washing water is supplied to the laundry treatment apparatus.

The stopping is carried out prior to the interrupting of the external electric power.

The leakage controlling method of the laundry treatment apparatus further includes draining the washing water when the leakage is detected in the detecting.

The draining is carried out prior to the interrupting of the external electric power.

The detecting step includes detecting a level of a water reservoir of the inner lower of the casing with the leakage detecting device; draining the washing water in the water reservoir for a predetermined time period when the level detected in the detecting a level is equal to or higher than a predetermined level; and determining the leakage as a continuous leakage when the level of the water reservoir is not lowered while the washing water in the water reservoir is drained and a temporary leakage when the level of the water reservoir is lowered.

The leakage controlling method of a laundry treatment apparatus further includes informing the exterior the leakage through an informing device when the leakage is detected in the detecting.

The informing step is carried out prior to interrupting of the external electric power.

The auxiliary electric power is supplied to the informing device during the informing after the interrupting of the external electric power.

The informing step is carried out until an informing release command is inputted.

The informing step is carried out a predetermined informing time period.

There is provided a leakage controlling method of a laundry treatment apparatus according to the present invention, including: detecting whether leak from a casing with a leakage detecting device; an informing the exterior through an informing device the leakage when the leakage is detected in the detecting; and interrupting an external electric power inputted to the laundry treatment apparatus when the leakage is detected in the detecting.

The leakage controlling method of the laundry treatment apparatus further includes stopping the supply of the washing water when the leakage is detected in the detecting and the washing water is supplied to the laundry treatment apparatus.

The leakage controlling method of the laundry treatment apparatus further includes draining the washing water when the leakage is detected in the detecting.

As described above, according to the laundry treatment apparatus and the water leakage controlling method thereof according to the present invention, the external electric power supplied to the laundry treatment apparatus is interrupted and the auxiliary electric power recharged during the supply of the main electric power is supplied to the laundry treatment apparatus when the water leakage is detected, so that the electric shortage and other accidents can be prevented and the informing device can be controlled with the auxiliary electric power to measure the leakage.

In addition, according to the laundry treatment apparatus and the water leakage controlling method thereof according to the present invention, the supply of the washing water to the laundry treatment apparatus is interrupted and the washing water in the tub and the drainage device is completely drained the possibility and quantity of the water leakage can be minimized.

Moreover, since the laundry treatment apparatus and the water leakage controlling method thereof according to the present invention include the informing device to inform and the step of the leakage to the user respectively, corrosion due to the leakage, an electric leakage, and other accidents, generated by re-operating the laundry treatment apparatus without being aware of the leakage, can be prevented.

In addition, in the laundry treatment apparatus and the water leakage controlling method thereof according to the present invention, the step of informing step is carried out with the auxiliary electric power separately provided, the user can be informed whether the washing water leaks or not, even after interrupting the external electric power.

Furthermore, in the laundry treatment apparatus and the water leakage controlling method thereof according to the present invention, since it is determined whether the present leakage is continued or temporarily occurs during the draining of the washing water from the water reservoir, it can be determined whether the leakage actually damages the laundry treatment apparatus or not, the undesired supply or the interruption of the washing water to or from the laundry treatment apparatus can be prevented, and the undesired interruption of the external electric power from the laundry treatment apparatus can be also prevented.

BRIEF DESCRIPTION OF THE DRAWINGS

A more compete appreciation of the invention, and many of the following aspects thereof, will be readily apparent as the same becomes better understood by reference to the following detailed description when considered in conjunction with the accompanying drawings in which same reference numerals are assigned to the same or similar components, wherein.

DETAILED DESCRIPTION OF THE INVENTION

In the following description, only exemplary embodiments of the present invention have been shown and described simply by way of illustration.

Hereinafter, a laundry treatment apparatus according to an embodiment of the present invention will be described with reference to the drawings.

Figure 1:
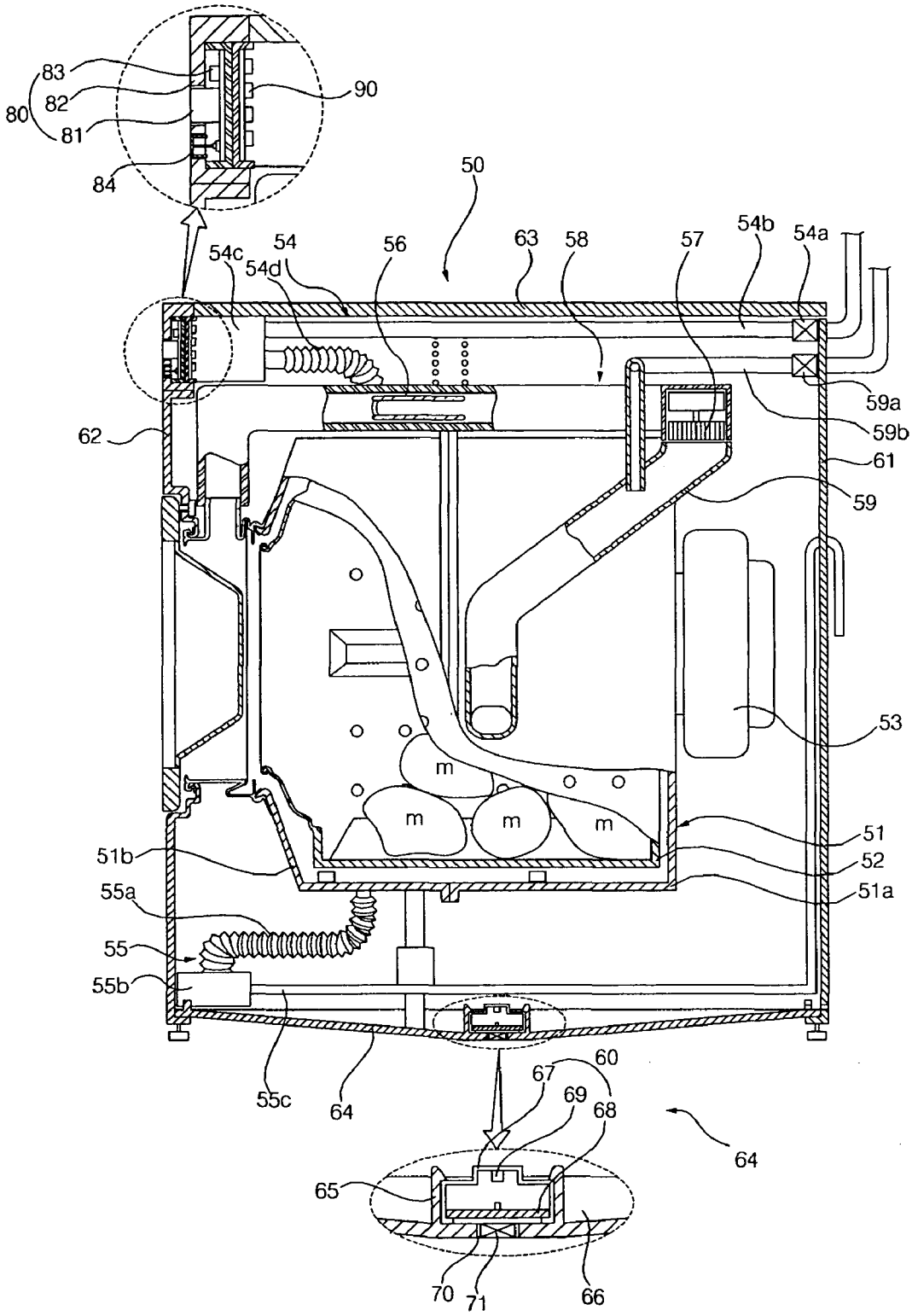
FIG. 1 is a cross-sectional view showing a laundry treatment apparatus according to an embodiment of the present invention.

FIG. 1 is a cross-sectional view showing a laundry treatment apparatus according to the embodiment of the present invention.

The laundry treatment apparatus, as shown in FIG. 1, includes a casing 50 forming an external appearance of the laundry treatment apparatus, a tub 51 installed in the casing 50 horizontally or at an angle, a drum 52 disposed to rotate in the tub 51 to accommodate laundry m, a driving device 53 having a motor to rotate the drum 52, a water supply device 54 supplying washing water to the tub 51, a drainage device 55 draining the washing water from the tub 51 out of the casing 50, a drying duct 58 having a heater 56 installed on the upper side of the tub 51 to discharge hot air into the tub 51 and a blower fan 57, a condensing duct 59 communicated with the tub 51 and the drying duct 58 to condense moisture contained in the air introduced from the tub 51 with cooling water, and a leakage detecting device 60 detecting the washing water leaked from the lower side of the casing 50.

The casing 50 includes a cabinet 61 having an opened front side and an opened upper side, a cabinet cover 62 mounted to the opened front side of the cabinet 61, a top cover 63 mounted to the upper side of the cabinet 61, and a base fan 64 coupled to the lower side of the cabinet 61 to form a base of the laundry treatment apparatus.

The tub 51 includes a rear tub 51*a* and a front tub 52*b*.

The water supply device 54 includes a water supply valve 54*a*, a water supply hose 54*b*, a detergent feeding device 54*c*, and a water supply bellows 54*d*, wherein the water supply valve 54*a*, the water supply hose 54*b*, the detergent feeding device 54*c* and the water supply bellows 54*d* communicate with each other in sequence to form a water supply passage.

The drainage device 55 include a drain bellows 55*a*, a drain pump 55*b* and a drain hose 55*c*, wherein the drain bellows 55*a*, the drain pump 55*b* and the drain hose 55*c* communicate with each other in sequence to form a drain passage.

The condensing duct 59 is connected to a cooling water supply supplying cooling water to the condensing duct 59. The cooling water supply includes a cooling water valve 59*a* and a cooling water hose 59*b*, wherein the cooling water valve 59*a* and the cooling water hose 59*b* communicate with each other in series to form a cooling water passage.

The water leakage sensing device 60 detects a washing water leaked from the tub 51, the water supply device 54 and the drainage device 55 dropped to the upper side of the base fan 64, and is preferably installed on the upper side of the base fan 64.

Figure 2:
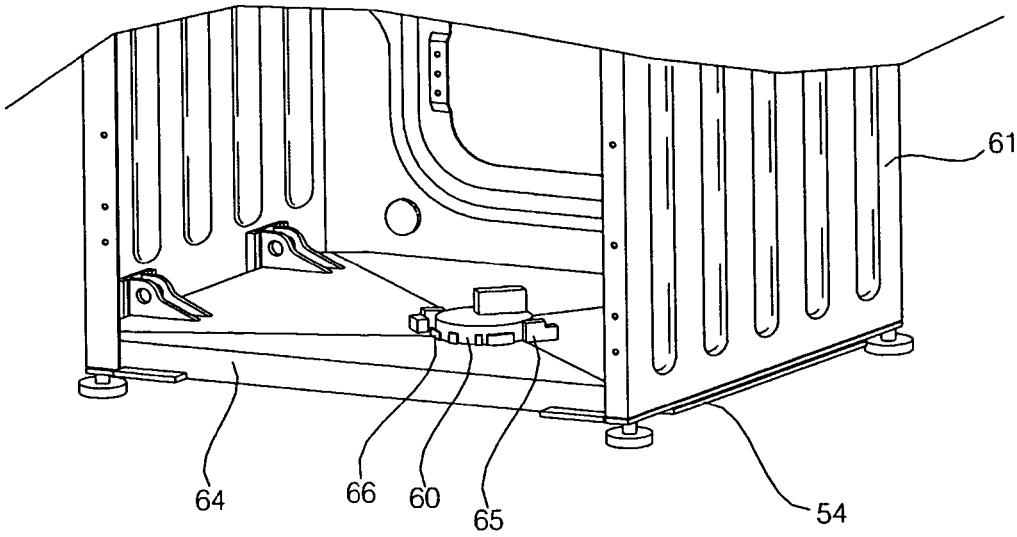
FIG. 2 is a partially sectional perspective view of a leakage detecting device of the laundry treatment apparatus shown in FIG. 1.

FIG. 2 is a partially sectional perspective view of a leakage detecting device of the laundry treatment apparatus shown in FIG. 1. The base fan 64 has a mounting portion 65 in the form of a hook or a rib to which the leakage detecting device 60 is mounted.

Preferably, the mounting portion 65 is formed in the approximately central region of the base fan 64.

The base fan 64 is configured to collect the leaking washing water is collected to the leakage detecting device 60, and has a water reservoir 66 downwardly inclined to a place on which the leakage detecting device 60 is mounted.

As shown in FIG. 1, the leakage detecting device 60 includes a sensor body 67 installed to the mounting portion 65, a float 68 disposed to elevate or lower in the sensor body 65, and a sensor 69 installed in the sensor body 67 to detect a position of the float 68.

The sensor body 67 includes an intake hole into which the washing water is introduced from the base fan 64 to float the float 68.

The sensor 69 may include a sensor detecting a distance between the sensor 69 and the float 68 or a switch (hereinafter, referred to as a 'float switch') to be switched by the float 68.

Figure 3:
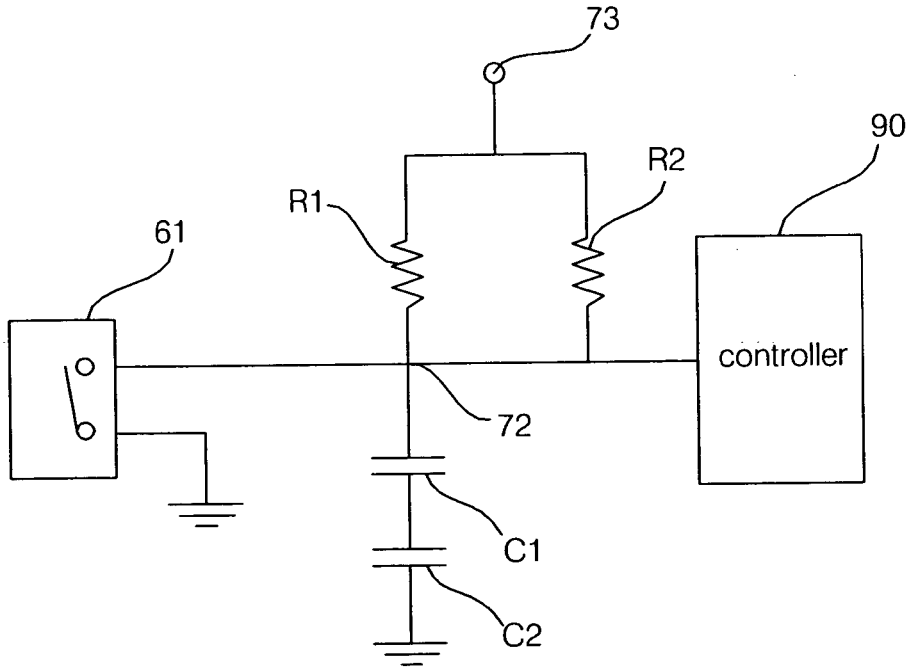
FIG. 3 is a block diagram showing a leakage detecting circuit of the laundry treatment apparatus according to the embodiment of the present invention.

FIG. 3 shows a circuit of the leakage detecting device of the laundry treatment apparatus according to the embodiment of the present invention.

The leakage detecting device 60 is configured such that the float switch 69 is connected between a first node 72 and the ground.

The first node 72 is connected to a controller 90 such that the potential thereof is supplied to the controller 90 described later.

The leakage detecting device 60 includes one or more capacitors C1 and C2 connected between the first node 72 and the ground to be parallel with the float switch 69 to maintain the potential difference, and one or more resistors R1 and R2 connected between the first node 72 and a second node 73 to which a voltage is applied to drop the voltage of the second node 73.

Meanwhile, the base fan 64, as shown in FIG. 1, a reservoir drain hole 70 formed in the water reservoir 65 such that the washing water contained in the water reservoir 65 is slowly drained.

The base fan 63 includes a reservoir valve 71 opening and closing the reservoir drain hole 70.

Meanwhile, the laundry treatment apparatus further includes an informing device 80 informing various information such as operating information of the laundry treatment apparatus to the exterior.

The informing device 80 includes a control panel 82 on which a display 81 displaying the operating information of the laundry treatment apparatus is installed, and a sound device 83 displaying the operating information of the laundry treatment apparatus in sound, such as a speaker, a boozer, or the like.

The control panel 82 includes an input device 84 having an input component inputting an operating command to the laundry treatment apparatus, such as a key, a switch, or the like.

Figure 4:
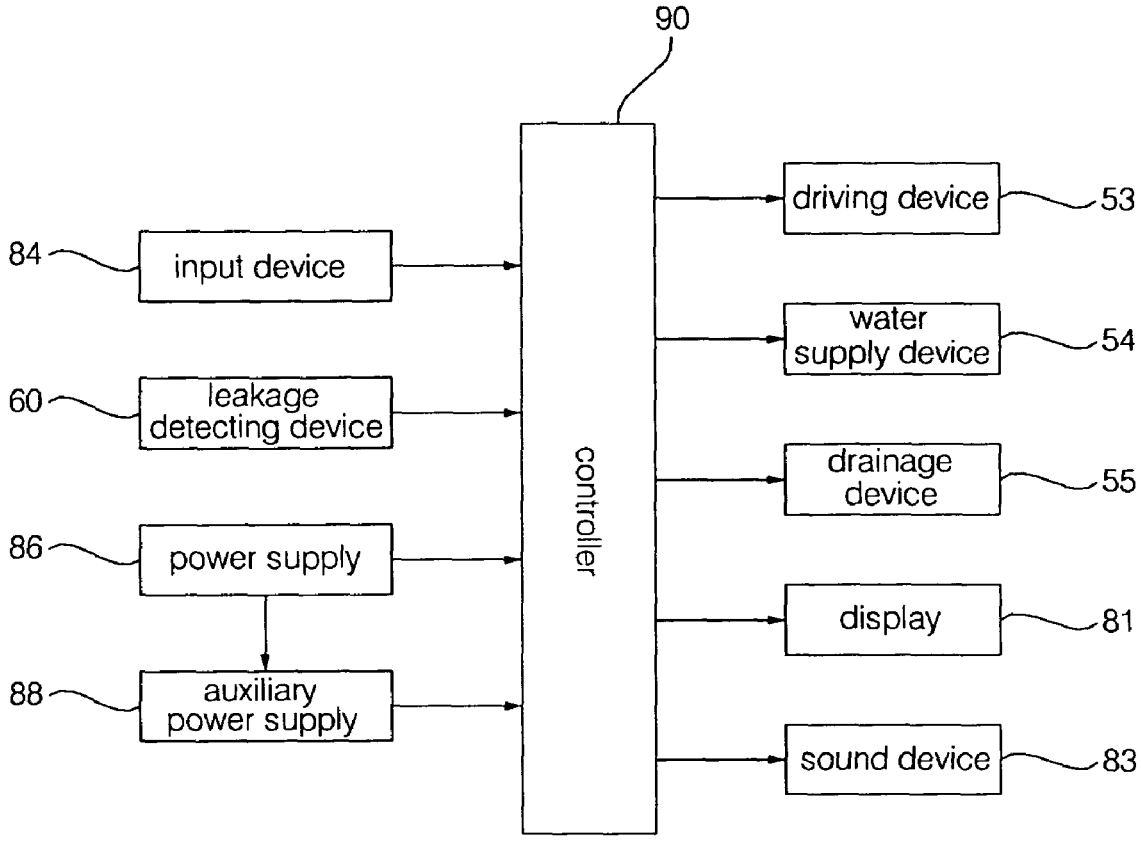
FIG. 4 is a block diagram showing a circuit for controlling the laundry treatment apparatus according to the embodiment of the present invention.

FIG. 4 is a block diagram showing a circuit for controlling the laundry treatment apparatus according to the embodiment of the present invention.

As shown in FIG. 4, the laundry treatment apparatus according to the present invention includes a main power supply 86 supplying an external electric power (hereinafter, referred to as a main electric power) to the laundry treatment apparatus when usually operating the laundry treatment apparatus, and an auxiliary power supply 88 separated from the main power supply 86 to supply the electric power to the informing device 80 the main electric power is interrupted.

The auxiliary power supply 88 may include a rechargeable power supply repeatedly recharged by the main power source, or a disposable capacitor type power supply such as a battery not repeatedly recharged. When the auxiliary power supply 88 includes the rechargeable power supply, a recharging device is provided to recharge the auxiliary power supply with the rechargeable power supply.

If the auxiliary power supply 88 includes the rechargeable power supply, in the laundry treatment apparatus, the recharging device recharges the rechargeable power supply with the auxiliary power supply 88, while the external electric power is supplied to the laundry treatment apparatus by the main power supply 80.

Meanwhile, the laundry treatment apparatus includes the controller 90 controlling at least one of the driving device 53, the water supply device 54, the drainage device 55, and the informing device 80, according to the detection by the leakage detecting device 60.

Here, when the leakage is detected by the leakage detecting device 60, the controller 90 can prevent the washing water from entering any more through the water supply device 54, can rapidly drain the washing water through the drainage device 55 to prevent the washing water from leaking to the base fan 63 or to minimize the amount of the leakage, can interrupt the external electric power supplied to the laundry treatment apparatus to stop the laundry treatment apparatus, and can inform a user whether the washing water leaks or not through the informing device 80.

The operation of the laundry treatment apparatus of the present invention constructed as described above will be described.

Figure 5:
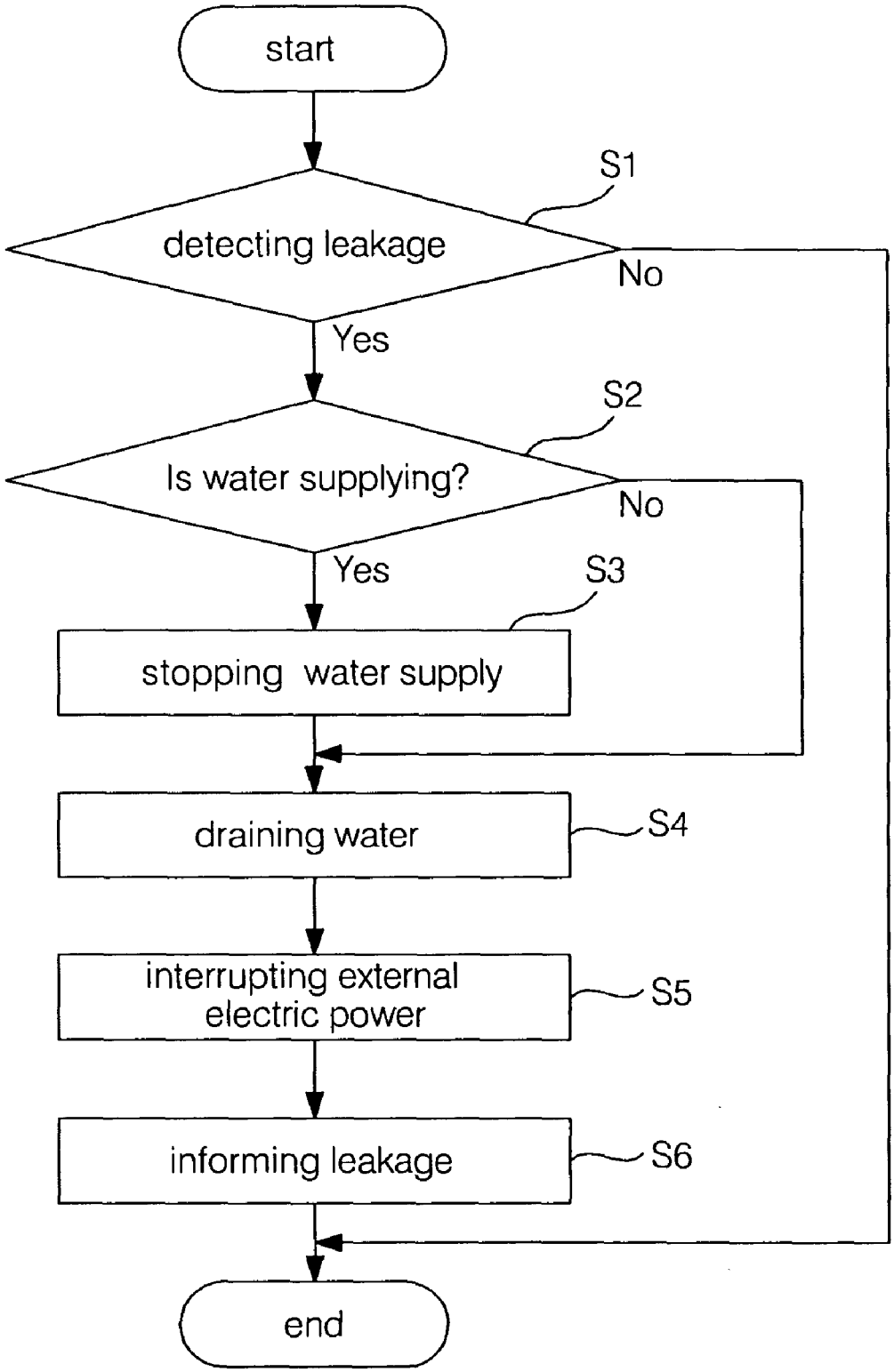
FIG. 5 is a flowchart showing a leakage controlling method of a laundry treatment apparatus according to an embodiment of the present invention.

FIG. 5 is a flow-chart showing a leakage controlling method of a laundry treatment apparatus according to an embodiment of the present invention.

As shown in FIG. 5, the leakage controlling method of a laundry treatment apparatus according to the present invention roughly includes detecting a water leakage (S1), settling leakage (S2 to S4) to operate the laundry treatment apparatus so as to minimize the leakage of the washing water, interrupting an external electric power (S5) from the laundry treatment apparatus, and supplying an external electric power recharged during the supply of the main electric power (S6).

Here, the settling (S2 to S4) includes at least one of stopping the supply of the washing water when the water supply device 54 supplies the washing water (S2 and S3), and draining the washing water by the drainage device 55. In the settling (S2 to S4), it is possible to carry out only the steps of stopping the supply of the washing water (S2 and S3) or only the draining (S4). Hereinafter, the settling will be described by the case to carry out both the stopping (S2 and S3) and the draining (S4).

Since the settling (S2 to S4), the interrupting (S5), the supplying the auxiliary electric power (S6) are carried out when the leakage of the washing water is detected during the detecting (S1), it is possible to carry out all the settling (S2 to S4), the interrupting (S5), and the supplying (S6) as well as only some of the steps without carrying out the rest steps.

Meanwhile, the supplying (S6) is carried out after the interrupting (S5).

The settling (S2 to S4) may be carried out either by the main electric power prior to the interrupting (S5), or by the auxiliary electric power, simultaneously with the supplying (S6) after performing the interrupting (S6).

Meanwhile, in the leakage controlling method of the laundry treatment apparatus according to the present invention, the leakage of the washing can be informed to the user by the informing device 80 when the water leaks, the informing device 80 can be controlled simultaneously with, after, or before carrying out at least one of the settling (S2 to S4) and the supplying (S6).

Hereinafter, for the convenience of the illustration, the leakage controlling method of a laundry treatment apparatus will be described by restricting when the detecting (S1), the settling (S2 to S4), the interrupting (S5) and the supplying (S6) are carried out in sequence, and the auxiliary electric power is supplied to the informing device 80 to inform the user that the washing water leaks in the laundry treatment apparatus.

Firstly, during the detecting (S1), the leakage detecting device 60 detects the leakage of the washing water and transmits a detecting signal to the controller 90 when the external electric power is supplied to the laundry treatment apparatus.

The controller 90 determined whether or not the washing water leaks or not using the detecting signal received from the leakage detecting device 60.

The controller 90 determined whether the washing water leaks continuously or temporarily using the signal generated by the leakage detecting device 60 and a variation of the signal. If the washing water continuously leaks, the controller 90 carries out the settling (S2 to S4) and the following steps (S5 and S6). If the washing water temporarily leaks, the controller 90 determines that the washing water does not leak without carrying out the leakage controlling. The determination between the continuous leakage and the temporary leakage will be described in detail later.

Meanwhile, when the leakage is determined, the controller 90 carries out the stopping (S2 and S3) and the draining (S4) as the settling (S2 to S4).

During the stopping (S2 and S3), the washing water is prevented from being supplied by the water supply device 54 to remove the reason of the leakage. When the water supply device 54 supplies the washing water at the present time, the supply of the washing water is interrupted (S2 and S3).

In other words, the controller 90 turns the water supply valve 54*a* of the water supply device 54 off to be closed, so that the washing water is supplied to the laundry treatment apparatus no more.

During the draining (S4), the possibility or the quantity of the leakage of the washing water is minimized by rapidly draining the washing water supplied into the tub 51, and the drainage device 55 drains overall washing water in the tub 51.

Namely, the controller 90 drives the drain pump 55*b* of the drainage device 55, and the washing water in the tub 51 passes through the drain bellows 55*a*, the drain pump 55*b* and the drain hose 55*c* in sequence to be drained out of the casing 50.

Since the controller 90 carries out the interrupting (S5) after completing the stopping (S2 and S3) and the draining (S4) as described above, the main electric power of the main power supply 86 connected to the external power source is interrupted, the laundry treatment apparatus does not operate without an additional action.

Moreover, the controller 90 carries out the supplying (S6) after interrupting the electric power supplied by the main power supply 86.

The supplying (S6) may be carried out until an informing release command is inputted through the control panel 80, or another device, be finished when the informing release command is input, and be finished after being carried out for a predetermined informing time period (for example, 3 minutes).

Meanwhile, during the supplying (S6), the electric power, recharged by the external power source prior to the interrupting (S5), is supplied to the control panel 80 in which the display 81 is installed and the sound device 83 such as a speaker, a boozer, and the like, and the display 81 and the sound device 83 is operated by the auxiliary electric power to inform whether the washing water leaks and whether the laundry treatment apparatus needs a repair, and a usage restriction.

Figure 6:
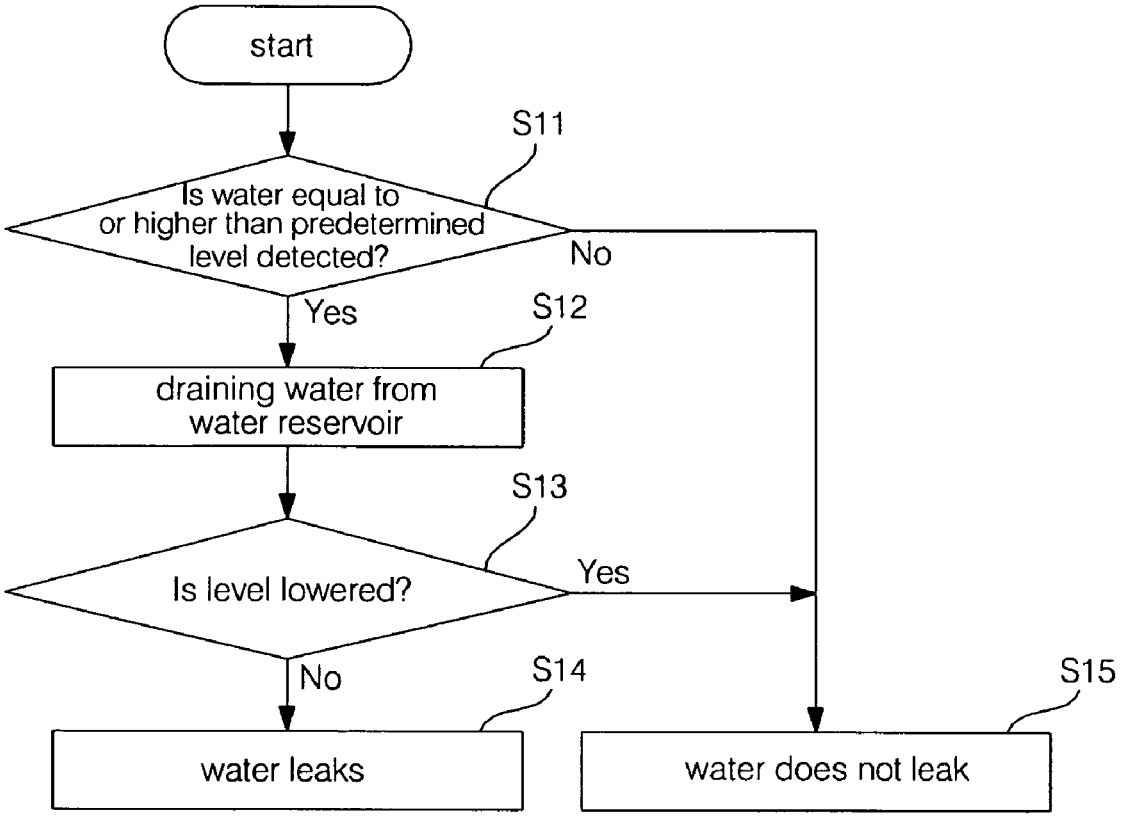
FIG. 6 is a flowchart showing a step of detecting leakage shown in FIG. 5.

FIG. 6 is a flow-chart showing the detecting shown in FIG. 5.

The detecting (S1) includes detecting a level of the water reservoir 66 (S11) by the leakage detecting device 60.

For example, when the water reservoir 66 keeps dry and the float switch 69 is opened, a voltage 5 V applied from the second node 73 is slightly dropped by the resistors R1 and R2, a predetermined potential difference between the voltage 5 V and the ground by the capacitors C1 and C2, and the controller 90 receives a signal of about 4.8 V.

On the other hand, when the washing water is collected into the water reservoir 66 and the level of the water reservoir 66 increases, the float switch 69 is switched from the opened state to a closed state, the first node 72 and the ground are shorted, the voltage 5 V, supplied from the second node 73 are completely dropped by the resistors R1 and R2 so that the potential at the first node 72 becomes 0 V and the controller 90 receives a signal of 0 V.

The controller 90 determines the potential of the signal transmitted from the first node 72 to detect the level of the water reservoir 66.

The detecting (S1) includes draining (S12) the water in the water reservoir (66) for a predetermined time period when the level detected during the detecting (S11) is higher than a predetermined level.

Here, the predetermined level is a level when the float switch 69 is closed.

In other words, when the water reservoir 66 is filled up with the washing water and the controller 90 receives the signal of 0 V, the controller 90 turns the water reservoir valve 71, installed in the lower side of the water reservoir 66, on to be opened for the predetermined time period such that the water in the water reservoir 66 is drained out of the casing 50 through a water reservoir drain hole 70 when the water reservoir valve 71 is turned on.

After that, the detecting (S1) includes determining (S13 to S15) the continuous leakage in which the water continuously leaks when the level of the water reservoir 66 is not lowered, and the temporary leakage in which a small amount of the washing water enters the water reservoir 66 from the exterior or that does not damage the laundry treatment apparatus when the level of the water reservoir 66 is lowered.

If the controller 90 continuously receives the signal of 0 V from the first node 72 during the draining (S13), the controller 90 determines the washing water continuously leaks and determines the leakage (S14).

To the contrary, if the controller 90 continuously receives the varied signal of about 4.8 V from the first node 63 during the draining (S13), the controller 90 determines the washing water leaks temporarily and determines that the washing water does not leak (S15).

That is, if the washing water in the water reservoir 66 is reduced during the draining the washing water out of the water reservoir 66, since the water reservoir 66 contains the washing water temporarily, the controller 90 determines that the washing water does not leak (S13 and S15).

To the contrary, if the water in the water storage portion 66 is not reduced, but remains, in spite of draining the washing water in the water reservoir 66, since the washing water continuously leaks and is collected in the water reservoir 66, the controller 90 determines the leakage (S13 and S14).

As described above, the laundry treatment apparatus and the leakage controlling method thereof according to the present invention have advantages as follows.

(See the last five paragraphs of "SUMMARY OF THE INVENTION") The acting effects of the laundry treatment apparatus and the water leakage controlling method thereof according to the present invention configured as noted above will be described.

The laundry treatment apparatus and the water leakage controlling method thereof according to the present invention has an advantage that since the external power source input to the laundry treatment apparatus is cut off and the reserve power source charged at the time of supplying the main power source is supplied to the laundry treatment apparatus in the case of sensing the water leakage, it is capable of preventing other accidents such as an electric leakage, etc., and taking following measures to handle the water leakage by controlling the informing device, and the like with the reserve power source.

In addition, the laundry treatment apparatus and the water leakage controlling method thereof according to the present invention has an advantage that it is capable of minimizing the possibility and quantity of the water leakage by blocking the supply of the wash water into laundry treatment apparatus and draining all wash water in the tub and the drainage device.

Moreover, the laundry treatment apparatus and the water leakage controlling method thereof according to the present invention has an advantage that since it comprises the informing device and informing step informing user, etc., the fact that the wash water is leaked, it is capable of preventing accidents such as a corrosion due to the water leakage, an electric leakage, etc., able to be generated by re-operating the laundry treatment apparatus without user's knowing of the water leakage.

In addition, the laundry treatment apparatus and the water leakage controlling method thereof according to the present invention has an advantage that since the informing step is carried out with the reserve power source separately equipped, it is capable of informing the user, etc., whether or not the water leakage occurs, even after the external power source is cut off.

Furthermore, the laundry treatment apparatus and the water leakage controlling method thereof according to the present invention has an advantage that since it discriminates whether the current water leakage is continuous or temporary while carrying out the drainage of the water in the water storage portion, it is capable of discriminating a substantial water leakage adversely affecting the laundry treatment apparatus and preventing the laundry treatment apparatus from unnecessarily stopping the water supply or draining water and the external power source of the laundry treatment apparatus from unnecessarily being cut off.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A leakage controlling method of a laundry treatment apparatus, comprising:

detecting leakage of washing water by a leakage detecting device provided at a lower part of a casing of the laundry treatment apparatus, wherein when the leakage is detected, the method further comprising:

draining washing water from a tub;

interrupting an external electric power supplied to the laundry treatment apparatus; and supplying an auxiliary electric power to an informing device that informs an exterior of the leakage, the auxiliary electric power being recharged by an external electric power while the external electric power is on, wherein the detecting comprises:

detecting a level of washing water in a water reservoir formed at the lower part of the casing with the leakage detecting device, draining the washing water in the water reservoir for a predetermined time period when the detected level of the washing water is equal to or higher than a predetermined level, and determining the leakage as a continuous leakage when the level of the washing water in the water reservoir is not lowered in response to the washing water in the water reservoir being drained and as a temporary leakage when the level of the washing water in the water reservoir is lowered in response to the washing water in the water reservoir being drained.

2. The leakage controlling method of a laundry treatment apparatus as claimed in claim 1, further comprising stopping the supply of the washing water when the washing water is supplied to the laundry treatment apparatus.

3. The leakage controlling method of a laundry treatment apparatus as claimed in claim 2, wherein the stopping is performed prior to the interrupting of the external electric power.

4. The leakage controlling method of a laundry treatment apparatus as claimed in claim 1, wherein the draining is performed prior to the interrupting of the external electric power.

5. The leakage controlling method of a laundry treatment apparatus as claimed in claim 1, wherein the informing is performed prior to the interrupting of the external electric power.

6. The leakage controlling method of a laundry treatment apparatus as claimed in claim 1, wherein the auxiliary electric power is supplied to the informing device during the informing and after the interrupting of the external electric power.

7. The leakage controlling method of a laundry treatment apparatus as claimed in claim 1, wherein the informing is performed until an input of an informing release command is inputted.

8. The leakage controlling method of a laundry treatment apparatus as claimed in claim 1, wherein the informing is performed for a predetermined informing time period.

* * * * *